US005197904A

United States Patent [19]

Gold

[11] Patent Number: 5,197,904

[45] Date of Patent: Mar. 30, 1993

[54] CONNECTOR FOR COAXIALLY SHIELDED CABLES

[76] Inventor: Michael Gold, 80 Oak Dr., Roslyn, N.Y. 11576

[21] Appl. No.: 941,235

[22] Filed: Sep. 4, 1992

[51] Int. Cl.[5] ..... H01R 9/07

[52] U.S. Cl. ..... 439/581; 439/736

[58] Field of Search ..... 439/578-585, 439/675, 736, 722; 29/883, 858, 848, 849

[56] References Cited

U.S. PATENT DOCUMENTS

| | | | |
|---|---|---|---|
| 4,284,321 | 8/1981 | DeTemple et al. | 439/736 |
| 4,484,792 | 11/1984 | Tengler et al. | 439/736 |
| 4,556,275 | 12/1985 | Hamsher, Jr. | 439/736 |
| 4,734,046 | 3/1988 | Mallister et al. | 439/63 |
| 4,941,831 | 7/1990 | Tengler et al. | 439/63 |
| 4,964,814 | 10/1990 | Tengler et al. | 439/607 |
| 4,981,445 | 1/1991 | Backer et al. | 459/736 |
| 5,116,244 | 5/1992 | Cartier | 439/581 |

*Primary Examiner*—David L. Pirlot
*Attorney, Agent, or Firm*—Charles E. Temko

[57] ABSTRACT

The disclosure relates to a specialized contact device for interconnecting the centrally positioned conductor and coaxially disposed shield of a shielded cable to points on a circuit board of an electronic chassis having plural pairs of spaced male pin contacts. The device includes a insulative housing element which encloses a solid metallic core having first and second bores therein corresponding to the male pin contacts. A first female contact is positioned within one of said bores. A second female contact is soldered to the signal conductor of the coaxial cable and is insulated from the surface of the second bore by an injected synthetic resinous insulative material which upon curing positions the second female contact and maintains it in proper position. In a preferred embodiment, a laterally extending bore communicates with the second longitudinal bore, and provides a gate for the injection of the insulative material.

7 Claims, 3 Drawing Sheets

CONNECTOR FOR COAXIALLY SHIELDED CABLES

BACKGROUND OF THE INVENTION

This invention relates generally to the field of specialized contacts for interconnecting the centrally disposed conductor and coaxially disposed shield of a shielded cable to points on a circuit board of an electronic chassis having plural pairs of spaced male pin contacts.

Both shielded cables and male pin contacts therefore are well known in the art, and are used principally in connection with high fidelity transmission of digital and audio signals in the communications industry. Connections of this type normally provide for a pair of spaced male pins on the circuit board which are usually arranged in parallel rows, so that pluralities of shielded cables may be interconnected to require only a small engaged area on the circuit board. In recent years, the proliferation of large numbers of specialized integrated circuits has increased the density of connections on circuit boards to a point where space limitations require connections of the smallest possible overall dimensions which can be arranged in abutting relation, while permitting convenient connection and disconnection of an individual cable. It is known in the art to provide connections of rectangular or cylindrical cross-section, including a female contact surrounded by an outer sleeve-like element which electrically communicates with the shield of the cable, the outer surface of the sleeve being positioned to contact a ground pin or its equivalent, as exemplified in the disclosure in U.S. Pat. No. 4,969,814 granted Oct. 23, 1990 to John N. Tengler, et. al. While not without utility, such connections provide a relatively large exposed conductive surface which is grounded, and which may inadvertently cause the unintended grounding of connectors adjacent to the positioned conductors. Further, because of the need to provide manually engagable surfaces to facilitate engagement and disengagement, such devices tend to be of undesirable elongated configuration, and of relatively complex manufacture.

It has also been recognized as desirable to provide the equivalent of extending the braided shield of the coaxial conductor the entire length of the signal conductor, that is to say to the engaged area of the circuit board for maximum shielding effect, and the above mentioned sleeve-like element achieves this result. With the present use of ever higher frequencies for data transmission, this desiratum becomes of correspondingly increased importance.

SUMMARY OF THE INVENTION

Briefly stated, the invention contemplates the provision of an improved coaxial connector of the class described, in which the above-mentioned disadvantages have been eliminated, or at least substantially alleviated. To this end, the disclosed embodiment comprises a five sided synthetic resinous outer shell of generally rectangular configuration. An end wall is provided with a pair of openings for the entry of signal and ground male contacts on a printed circuit board. An oppositely disposed end of the housing defines an opening leading to an axially aligned recess. Positioned within the recess is a solid metallic core of copper or other suitable conductive material having a pair of female contacts aligned within accurately spaced through bores, each communicating with an opening in the end wall of the housing.

A first female contact is press fitted into a first of said bores, and receives a ground pin on the circuit board. The second bore is of somewhat greater width, and receives the outer shield of a coaxial cable which is soldered or crimped thereto for electrical communication. The coaxial signal conductor of the cable extends into the bore and is soldered to a second female contact for engagement with the male signal pin o the printed circuit board. In a preferred embodiment, the core is provided with a laterally extending bore communicating with the last mentioned through bore which forms a sprue for the injection of a synthetic resin which surrounds the second female contact and the signal conductor to insulate them from the surface of the second bore, and maintain the female contact in axial alignment. The core is maintained within the outer shell as a press fit or by resilient detent means.

To facilitate assembly, the coaxial conductor is prepared by stripping the outer insulation and dielectric sleeve to standardized lengths. The bared coaxial shield is fitted with a tubular sleeve which accurately positions the prepared end of the coaxial cable within the larger bore, electrical communication being established either by soldering or crimping a part of the core thereon. The exposed end of the signal conductor, also of standardized length, is also fitted with a tubular sleeve which acts as a limit stop relative to the signal conductor male pin which is engaged with the female terminal on the end of the signal conductor.

BRIEF DESCRIPTION OF THE DRAWING

In the drawing, to which reference will be made in the Specification, similar reference characters have been employed to designate corresponding parts through the several views.

DETAILED DESCRIPTION OF THE DISCLOSED EMBODIMENT

Figure 1:
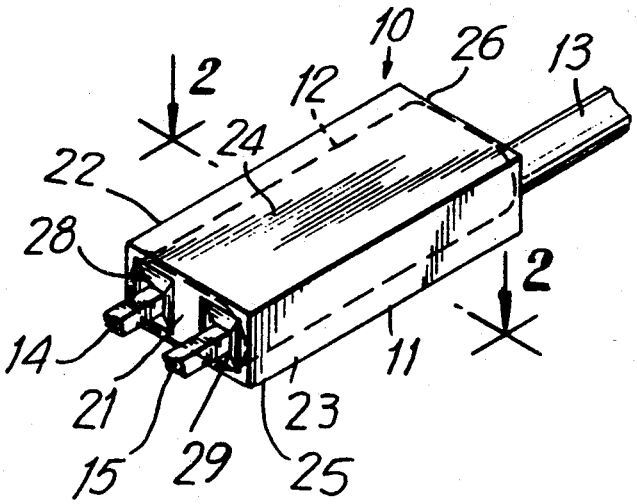
FIG. 1 is a fragmentary view in perspective of an embodiment of the invention.
Figure 3:
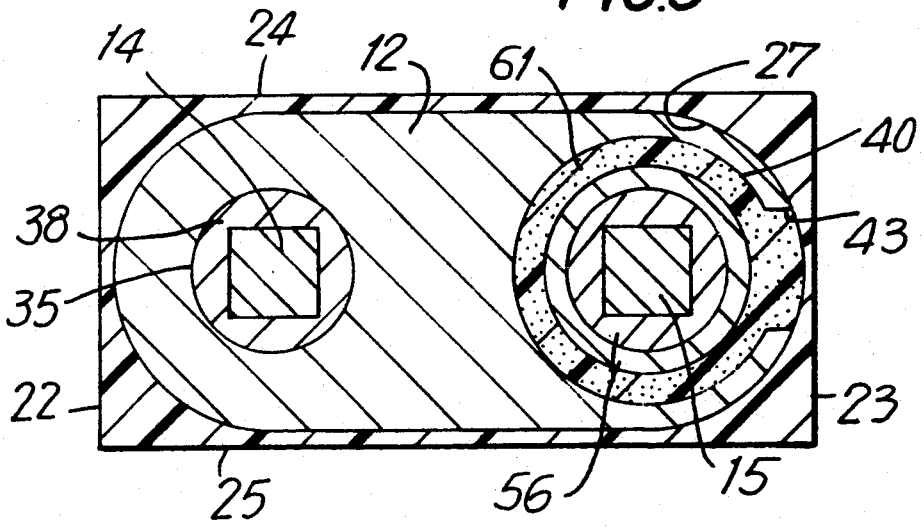
FIG. 3 is a transverse sectional view as seen from the plane 3—3 in FIG. 2.

In accordance with the invention, the device, generally indicated by reference character 10 comprises broadly: an outer shield element 11, and a core element 12 engaged therewith for the termination of a known coaxial cable 13 with first and second male pins 14 and 15 of a circuit board 16. The details of the circuit board 16 are well known in the art, and form no part of the present disclosure.

The outer shield element 11 is preferably formed by injection molding of synthetic resinous material, and is preferably of rectangular configuration in keeping with the geometry of the circuit board with which it is engaged. It is bounded by an end wall 21, a pair of relatively narrow side walls 22 and 23, and a pair of relatively wider side walls 24 and 25, which walls define an open end 26 leading to a hollow cavity 27 into which the core element 12 is press fitted or optionally retained by resilient detent means (not shown). The end wall 21 is provided with first and second openings 28 and 29 through which the pins 14 and 15 are selectively projected during engagement of the connector upon the board.

Figure 4:
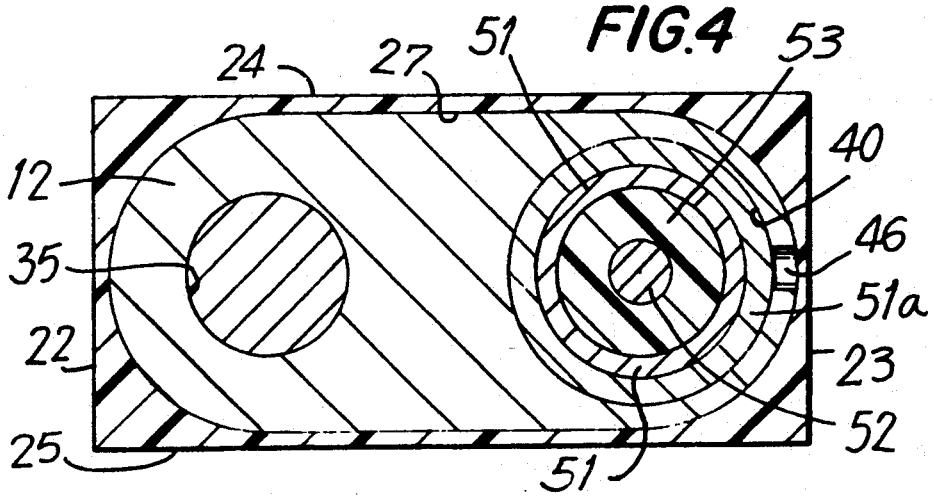
FIG. 4 is a transverse sectional view as seen from the plane 4—4 in FIG. 2.
Figure 2:
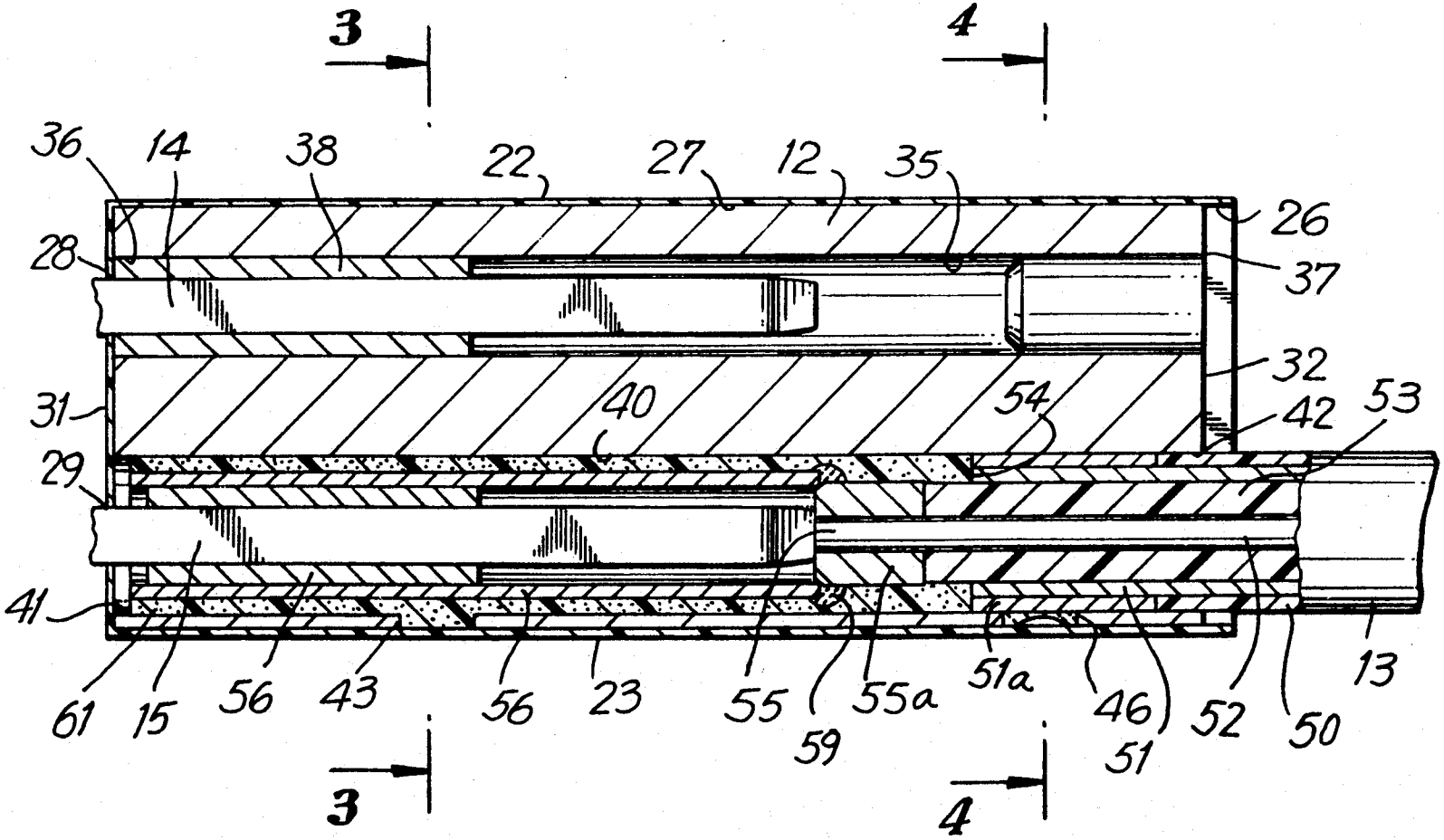
FIG. 2 is an enlarged longitudinal central sectional view as seen from the plane 2—2 in FIG. 1.

The core element 12 (FIG. 2) is preferably formed of solid copper or similar material. It may also be formed as an aluminum die casting, or, using semi-precious metal as a casting resulting from a lost wax process. It is bounded by first and second end walls 31 and 32 as well as a continuous ovoid side surface 33. Extending longitudinally within the body of the core is a first longitudinally oriented bore 35 having first and second ends 36 and 37, respectively. A first female contact 28 (FIG. 4) is press fitted at the end 36 thereof and establishes electrical communication with the core to one of the male pins 14–15 when the device is engaged upon the circuit board. A second through bore 40 is of somewhat larger diameter, and extends from a first end 41 to a second end 42. A first transversely oriented bore 43 interconnects the outer surface 33 with the second bore 40.

A second transversely oriented bore 46 is positioned near the end 37 and provides means for the injection of molten solder.

The coaxial cable 13 is well know type, including an outer jacket 50, a braided shield 51 which surrounds a signal conductor 52 having a coaxially aligned dielectric cover 53. An exposed free end 54 of the shield 51 is surrounded by a soldered cylindrical sleeve 51*a* which is fitted to the end 32 of the core element to establish a ground conductor to the contact 38, to be maintained by a crimping step or a soldering step.

Figures 5, 6:
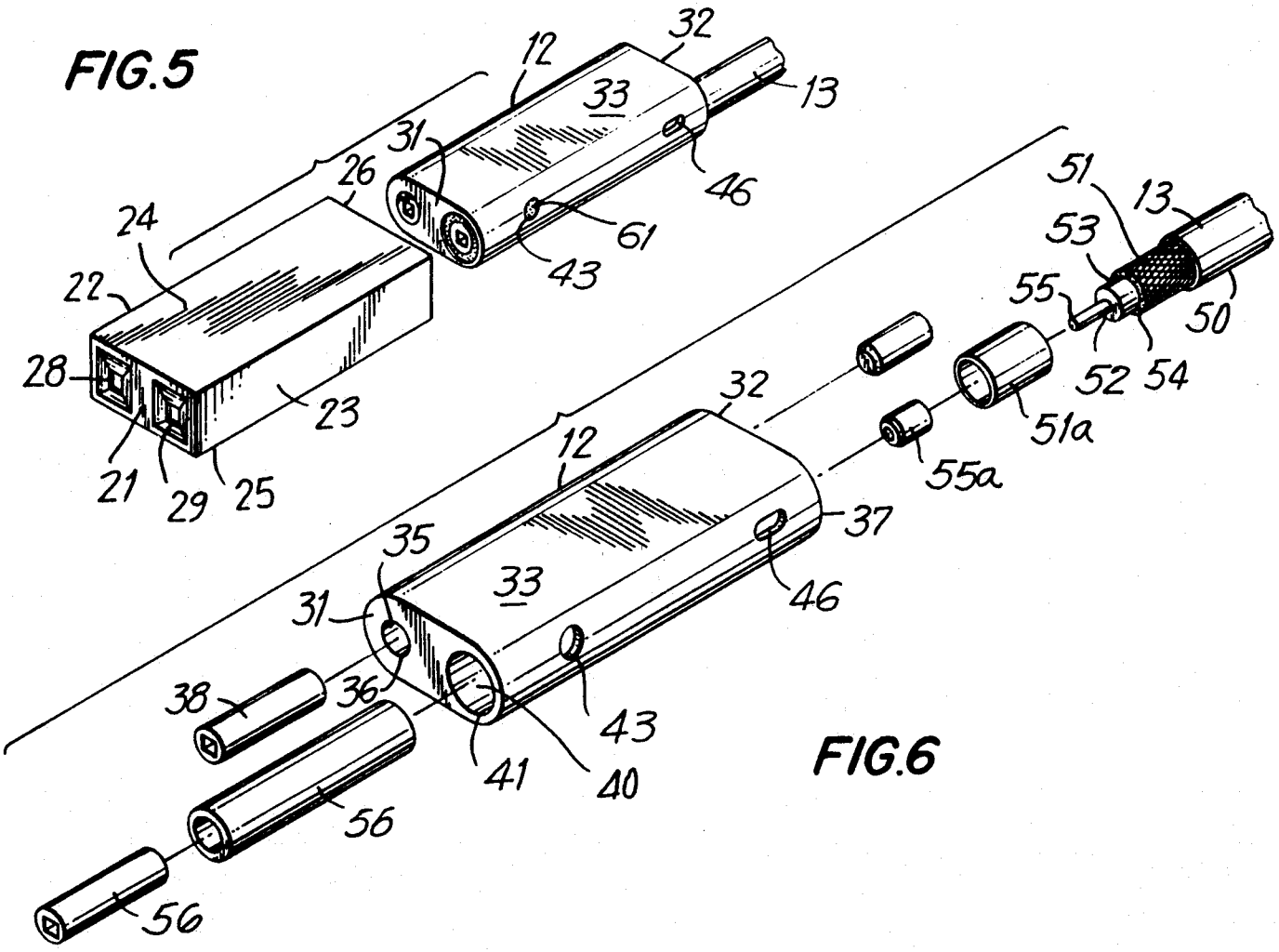
FIG. 5 is a fragmentary exploded view in perspective showing housing and core elements.
FIG. 6 is a fragmentary exploded view in perspective showing the component parts contained within the core element.

The signal conductor 52 and its dielectric shield 53 project into the bore 40, the exposed end 55 of conductor 52, being soldered to a second female contact 56 (FIG. 5), the effective diameter of which is substantially smaller than that of the bore 40. The end 55 is also provided with a cylindrical sleeve, the free end of which serves to determine the limit of axial engagement of the corresponding male pin at the free end of the contact 56. An opposite end 57 of the contact 56 is thereby positioned adjacent the end 41 of the bore 40.

When the core element 13 is assembled to the cable 13, the parts will be positioned substantially as shown in FIG. 1 after the soldering of the shield 51, and overlying sleeve 51*a*. Thereafter, using a support (not shown) inserted into the free end 52 of the bore 40 and engaging the free end of the contact 56, a quantity of synthetic resinous material 61 is injected through the transversely extending bore 43 to result in completely insulating the contact 56 and its solder joint 59 from the inner surface of the second bore 40 and fixing the cable longitudinally. The material 61 is cured in situ. After curing, the support (not shown) is removed, and the core element 12 is then press fitted within the shield element 11 to complete assembly. The injected material may be a mineral filled expoxy which cures at a relatively low temperature, thereby assuring that the temper of the metallic parts will not be derogated.

Where the core element 13 is of relatively ductile material such as aluminum, the cable 13 with soldered sleeve 51*a* may be anchored in position by crimping the related end of the core element 13 thereupon, thereby eliminating the need for the bore 46. The second contact 56 may also be insulated from the second bore 40 by inserting a tubular insulative sleeve (not shown) from the free end 41. This may be of relatively rigid synthetic resinous material such as styrene tubing. Further, using a suitable fixture, material injected through the bore 46 may also be injected from the end of the second bore, albeit not quite as conveniently. The bores 43 and 46 may be located on planar portions of surface 33, if desired.

It may thus be seen that I have invented novel and highly useful improvements in a connector for coaxially shielded cables, in which I have provided for relatively low cost of manufacture, consistent with the high commercial tolerances normally required in devices of this type. Most suitably, the outer insulative shield is formed as a injected molded product. The solid core is most suitably formed from relatively soft copper or similar materials, by die casting, or a lost wax process. Only two solder joints are necessary, one of which may be eliminated by crimping operation after the coaxial cable is associated within the core element and following this interconnection, the signal conductor contact which is insulated from the core is permanently seated by injection molding of synthetic resinous materials which serve the joint purpose of anchoring the contact in proper position and insulating it from the surrounding conductive surfaces of the bore in which it is disposed. The device may be formed using female contacts of known configuration widely used in the communications field, thereby keeping cost of manufacture at a very reasonable level. contact in proper position and insulating it from the surrounding conductive surfaces of the bore in which it is disposed. The device may be formed using female contacts of known configuration widely used in the communications and electronics field.

I wish it to be understood that I do not consider the invention to be limited to the precise details of structure shown and set forth in the specification, for obvious modifications will occur to those skilled in the art to which the invention pertains.

I claim:

1. A termination connector for a coaxial cable having a signal conductor and a coaxial metallic sleeve comprising: An outer synthetic resinous shell forming a housing element having an insulative outer surface, having a transversely extending wall at a first longitudinal end thereof, and a continuous side wall defining a cavity; a solid metallic core element having first and second end surfaces and a continuous longitudinal side surface corresponding to the internal configuration of said cavity and positioned therein; said core having first and second longitudinal through bores extending in spaced parallel relation between said first and second ends, said end wall of said shield element having openings therethrough corresponding to said bores; said first longitudinal bore having a female contact fitted therein and electrically communicating therewith; said second bore forming a surface at a first end thereof for the electrical interconnection of an exposed segment of said shield of the coaxial cable whereby said signal conductor of said cable projects into said bore; a second female contact assembly soldered to a free end of said signal conductor and having a free end thereof positioned adjacent to the opposite end of said second bore; and a layer of insulative material surrounding the outer surfaces of said second female contact assembly and said signal conductor, said layer being injected into said second bore and cured in place.

2. A connector in accordance with claim 1, in which said core element is press fitted within said outer shell element.

3. A connector in accordance with claim 1, said first end of said core being soldered to retain said cable within said second bore.

4. A connector in accordance with claim 1, including a cylindrical sleeve surrounding an exposed end of said signal conductor of said coaxial cable to provide means limiting the ingress of a male pin into said second female contact.

5. A connector in accordance with claim 1, said core element defining a transversely oriented bore extending from said second bore to said side surface, said insulative material being injected therethrough.

6. A connector in accordance with claim 1, said first end of said core being crimped to retain said cable within said second bore.

7. A connector in accordance with claim 3, including a cylindrical sleeve surrounding the exposed shield of said cable in the area of said first end of said second bore.

* * * * *